US010263364B1

(12) United States Patent
Huang

(10) Patent No.: US 10,263,364 B1
(45) Date of Patent: Apr. 16, 2019

(54) PULL-TYPE TRIPPING DEVICE FOR ELECTRICAL CONNECTOR

(71) Applicant: BizLink International Corp., New Taipei (TW)

(72) Inventor: Cheng-Wei Huang, Taipei (TW)

(73) Assignee: BizLink International Corp., New Taipei (TW)

( * ) Notice: Subject to any disclaimer, the term of this patent is extended or adjusted under 35 U.S.C. 154(b) by 0 days.

(21) Appl. No.: 15/995,103

(22) Filed: May 31, 2018

(30) Foreign Application Priority Data

Sep. 29, 2017 (CN) ..... 2017 2 1267924 U

(51) Int. Cl.
*H01R 13/62* (2006.01)
*H01R 13/627* (2006.01)
*H01R 13/64* (2006.01)
*H01R 13/633* (2006.01)

(52) U.S. Cl.
CPC ..... *H01R 13/6273* (2013.01); *H01R 13/633* (2013.01); *H01R 13/64* (2013.01)

(58) Field of Classification Search
CPC ..... H01R 13/633; H01R 13/6335; H01R 13/639; H01R 13/6275; H01R 13/6272; H01R 13/6273
See application file for complete search history.

(56) References Cited

U.S. PATENT DOCUMENTS 5,660,558 A * 8/1997 Osanai ..... H01R 13/508 439/353
6,346,002 B1 * 2/2002 Hsu ..... H01R 13/6275 439/352
6,641,425 B1 * 11/2003 Wu ..... H01R 13/6275 439/352
6,821,139 B1 * 11/2004 Wu ..... H01R 13/6275 439/352
7,163,413 B2 * 1/2007 Murayama ..... H01R 13/6272 439/258
7,322,845 B2 * 1/2008 Regnier ..... H01R 13/6275 439/352
7,422,464 B2 * 9/2008 Lloyd ..... G02B 6/4277 385/53
7,435,129 B2 * 10/2008 Su ..... H01R 13/405 439/483

(Continued)

FOREIGN PATENT DOCUMENTS

CN 2785188 Y 5/2006

*Primary Examiner* — Edwin A. Leon
*Assistant Examiner* — Milagros Jeancharles
(74) *Attorney, Agent, or Firm* — CKC & Partners Co., LLC

(57) ABSTRACT

A pull-type tripping device for an electrical connector has a housing unit and a connector body unit. The connector body unit is disposed inside the housing unit, the connector body unit has a board body and a frame body vertically coupled to each other, a plurality of contact terminals are formed inside the frame body, and each upper portion of two sides of the frame body is formed a hook opening thereon. The pull-type tripping device includes a snap hook unit and a pull belt. The snap hook unit includes a fix arm, a flexible arm, and two snap hook arms. Each of the snap hook arms is disposed inside the frame body, and each of the two snap hook arms is removably buckled at the hook opening.

3 Claims, 4 Drawing Sheets

(56) References Cited

U.S. PATENT DOCUMENTS

| | | | | |
|---|---|---|---|---|
| 7,591,664 | B2 * | 9/2009 | Nomiyama | H01R 13/6275 439/352 |
| 8,475,197 | B2 * | 7/2013 | Zerebilov | H01R 13/6275 439/352 |
| 8,475,199 | B2 * | 7/2013 | Wang | H01R 13/6335 439/160 |
| 9,197,015 | B2 * | 11/2015 | Tanaka | H01R 13/639 |
| 9,246,262 | B2 * | 1/2016 | Brown | H01R 13/62 |
| 9,728,871 | B1 * | 8/2017 | Gutgold | H01R 12/515 |
| 2005/0054236 | A1 * | 3/2005 | Shi | H01R 13/6335 439/483 |
| 2006/0134985 | A1 * | 6/2006 | Reed | H01R 13/6275 439/607.01 |
| 2012/0329305 | A1 * | 12/2012 | Ritter | H01R 13/6275 439/350 |
| 2014/0134898 | A1 * | 5/2014 | Wang | H01R 13/6275 439/843 |
| 2015/0303608 | A1 * | 10/2015 | Zerebilov | H01R 13/6273 439/638 |
| 2018/0233855 | A1 * | 8/2018 | Phillips | H01R 12/7029 |

* cited by examiner

PULL-TYPE TRIPPING DEVICE FOR ELECTRICAL CONNECTOR

RELATED APPLICATIONS

This application claims priority to China Application Serial Number 201721267924.3, filed Sep. 29, 2017, which is herein incorporated by reference.

TECHNICAL FIELD

The present invention relates to a tripping device, and more particularly, to a pull-type tripping device for an electrical connector.

BACKGROUND

Besides using contact terminals to achieve an electrical connection between an electrical connector and a corresponding electrical connector, a mechanical connection between the electrical connector and the corresponding electrical connector is getting firmer by using the snap hook of the electrical connector to buckle with the hook opening of the corresponding electrical connector. To pull out the corresponding electrical connector from the electrical connector, it is necessary to firstly decouple the connection between the snap hook of the electrical connector and the hook opening of the corresponding electrical connector.

A conventional tripping device of the electrical connector is a button type tripping device that a tripping button of the electrical connector is disposed on an end surface of the electrical connector and the tripping button goes deep into the interior of the electrical connector. The tripping button is linked to the snap hook. When the tripping button is pressed, the snap hook can be driven to sink and release the buckles between the snap hook and the hook opening of the corresponding electrical connector, so that the corresponding electrical connector can be removed.

However, nowadays the distance between each component on the motherboard is getting smaller and smaller. When the housing or obstacle is too close to the tripping button, the finger cannot go deeply to press the tripping button so as to cause an inconvenience on the tripping operation.

SUMMARY

One aspect of the present invention is to provide a pull type tripping device capable of facilitating the release of the snap hook buckles between the electrical connector and the corresponding electrical connector.

According to an exemplary embodiment of the present invention, a pull type tripping device for an electrical connector is provided. The electrical connector includes a housing unit and a connector body unit. The housing unit includes a front housing and a rear housing that are oppositely coupled to each other. The rear housing has a first opening slit, the connector body unit is disposed inside the housing unit, and the connector body unit includes a board body and a frame body vertically coupled to each other. Inside the frame body, a plurality of contact terminals are formed, and each upper portion of two sides of the frame body has a hook opening formed thereof. The pull-type tripping device includes a snap hook unit and a pull belt. The snap hook unit includes a fixed arm spanned and fixed on a top surface of the board body, an flexible arm disposed consecutively at a front end of the fix arm and extended along two sides of the fix arm, and two snap hook arms respectively disposed at two outer ends of the flexible arm and extended downwards and forwards, each end of each of the two snap hook arms has a snap hook, each of the two snap hook arms is disposed inside the frame body, and each of the snap hooks is snapped at one hook opening and the snap hooks can be unblocked. The pull belt has a first end and a second end opposite to the first end. The first end is fixed to the front housing, and the second end spans over a top surface of the flexible arm and passes through the first opening slit. In addition, a position of the second end of the pull belt on the top surface of the flexible arm is higher than a fixed point position for fixing the first end of the pull belt to the front housing.

According to an exemplary embodiment of the present invention, an upper portion of the front housing has a frame opening, and the front housing has an outer frame body, and an inner frame body is disposed at the upper portion of the front housing. The inner frame body is placed between the outer frame body and the frame opening, and a second opening slit is formed between the inner frame body and the outer frame body, the first end of the pull belt passes through the second opening slit and the frame opening and is fastened to the inner frame body.

According to an exemplary embodiment of the present invention, the frame body of the connector body unit protrudes outward through the frame opening of the front housing.

According to the pull-type tripping device for an electrical connector of the present invention, the flexible arm and its snap hook arm can be forced down by tightening the second end of the pull tape so that the snap hook at the end of the snap hook arm moves downwards identically, hence releasing the buckles between the electrical connector and the corresponding electrical connector in a limited space. The operation of the present invention is extremely simple.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
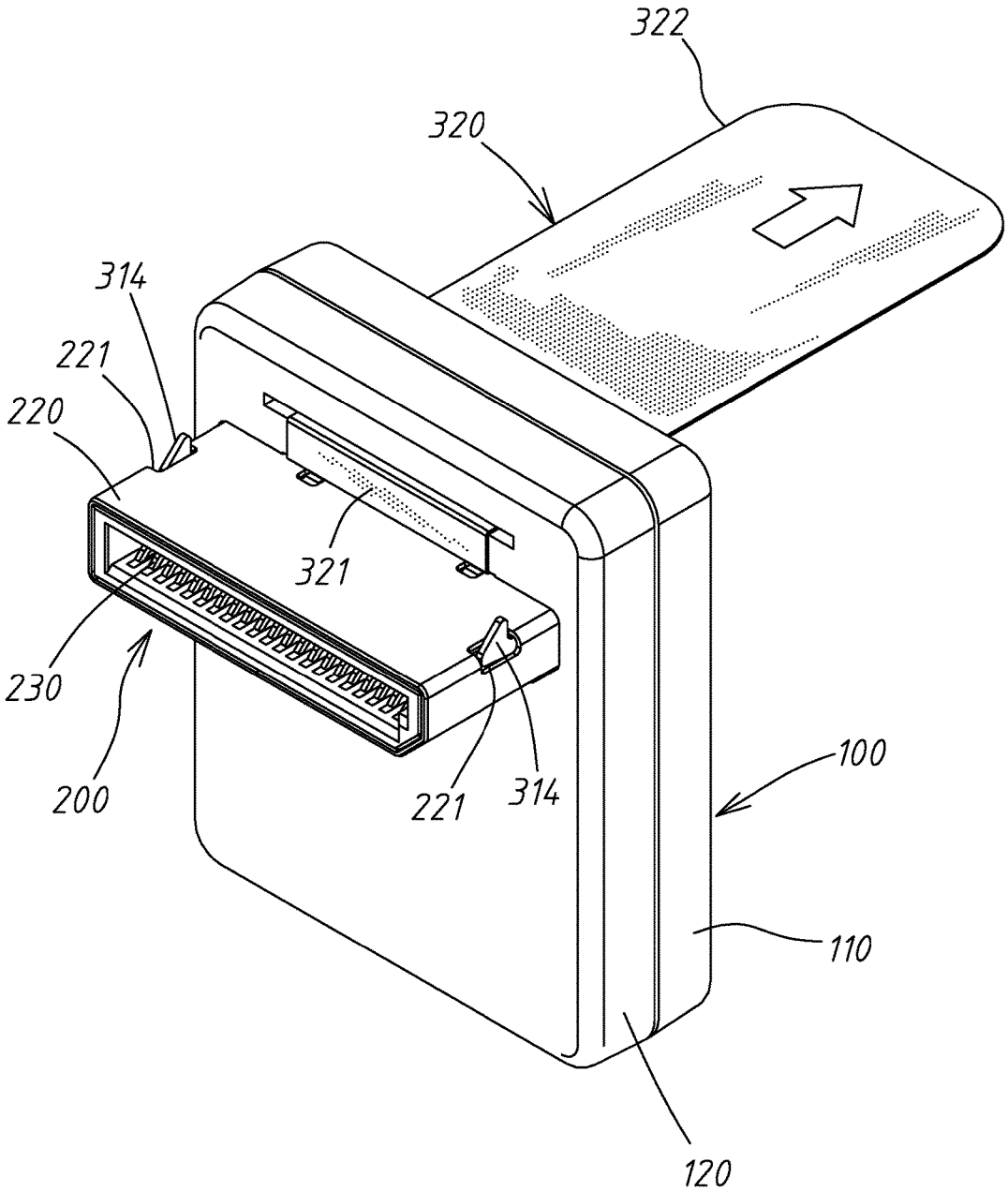
FIG. 1 is a diagram illustrating an appearance of a pull-belt tripping device of an electrical connector according to an embodiment of the present invention.
Figure 2:
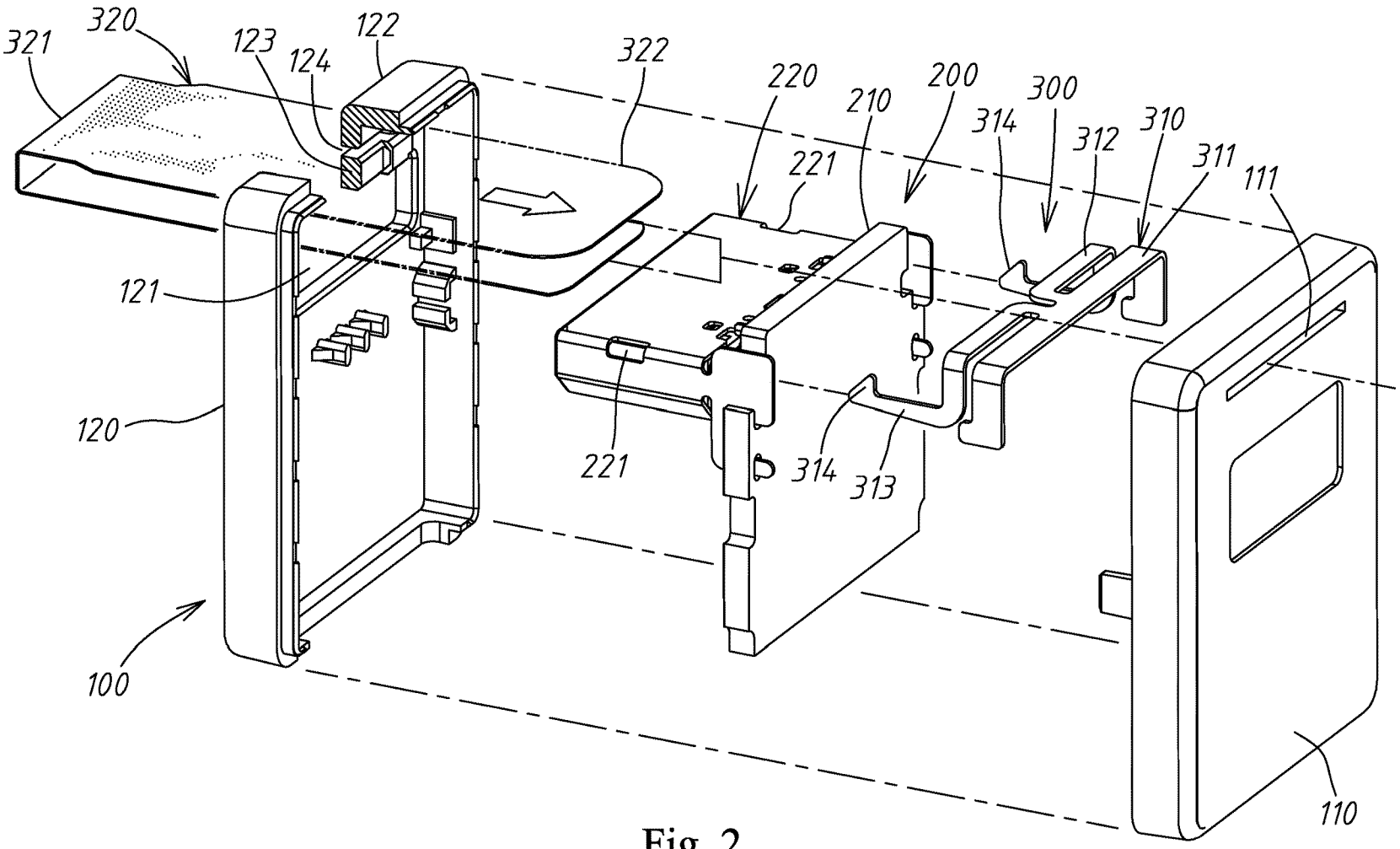
FIG. 2 is an exploded view of the pull-type tripping device of the electrical connector in FIG. 1.
Figure 3:
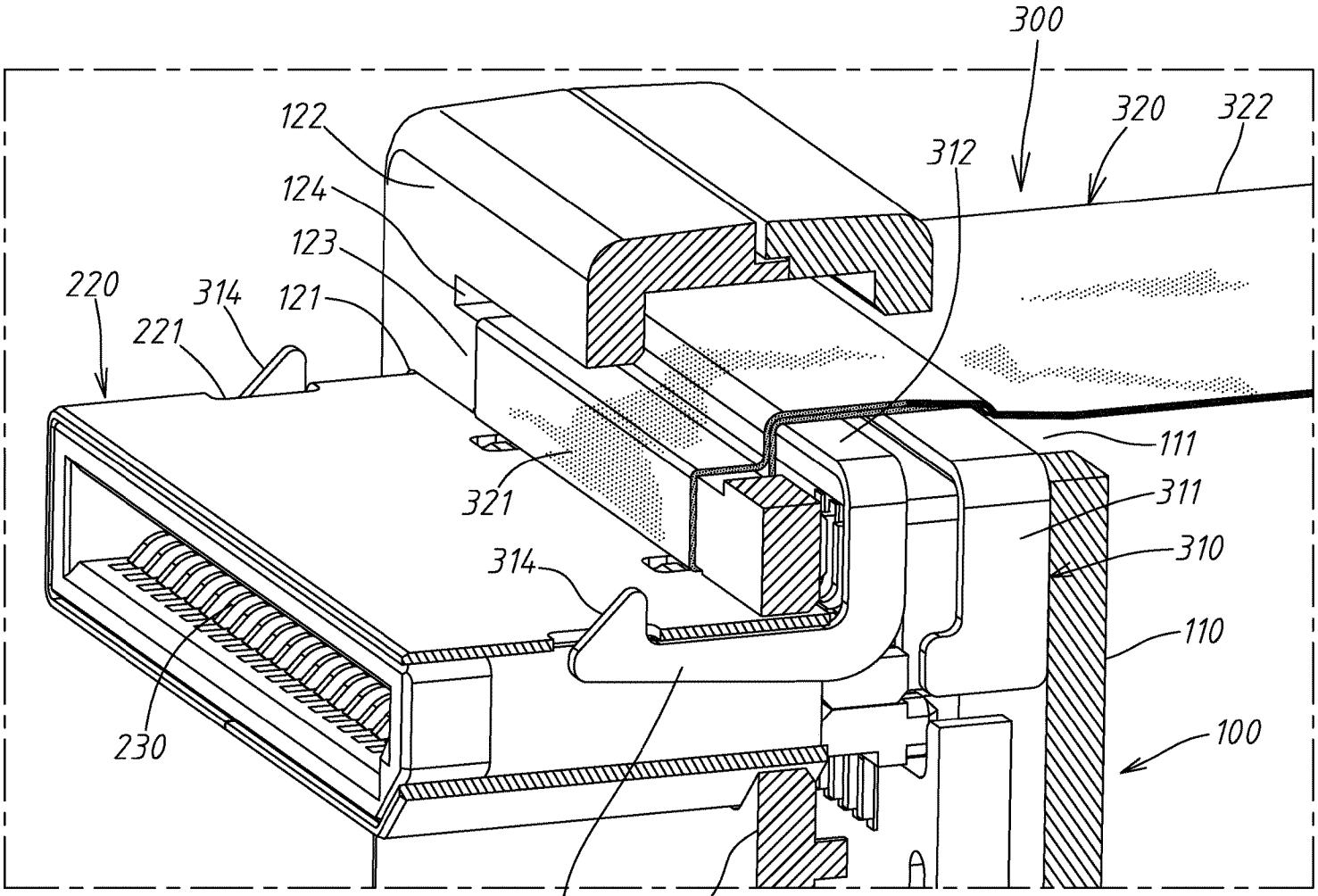
FIG. 3 is a partial three-dimensional, cross-sectional view of the pull-type tripping device of the electrical connector in FIG. 1.

Reference will now be made in detail to the present embodiments of the invention, examples of which are illustrated in the accompanying drawings. Wherever possible, the same reference numbers are used in the drawings and the description to refer to the same or like parts.

Referring to FIG. 1 to FIG. 5, the pull-type tripping device 300 is applied to an electrical connector so as to easily release the buckles between the electrical connector and a corresponding electrical connector.

The electrical connector includes a housing unit 100 and a connector body unit 200.

The housing unit 100 includes a front housing 120 and a rear housing 110 oppositely coupled to the front housing 120. The rear housing 110 is provided with a first opening slit 111. The upper portion of the front housing 120 has a frame opening 121, and the front housing 120 has an outer frame body 122, and an inner frame body 123 is at the upper portion of the front housing 120. The inner frame body 123 is placed between the outer frame body 122 and the frame opening 121, and a second opening slit 124 is formed between the inner frame body 123 and the outer frame body 122.

The connector body unit 200 is disposed inside the housing unit 100. The connector body unit 200 includes a board body 210 and a frame body 220 vertically coupled to each other. The frame body 220 protrudes outward through the frame opening 121 of the front housing 120. Inside the frame body 220, a plurality of contact terminals 230 are formed, and each upper portion of two sides of the frame body 220 has a hook opening 221 formed thereon.

According to an exemplary embodiment, the pull-type tripping device includes a snap hook unit 310 and a pull belt 320.

The snap hook unit 310 includes a fix arm 311, a flexible arm 312 and two snap hook arms 313. The fix arm 311 is spanned and fixed on a top surface of the board body 210 of the connector body unit 200. The flexible arm 312 is disposed consecutively at a front end of the fix arm 311 and is extended along two sides of the fix arm 311. The two snap hook arms 313 are respectively disposed at two outer ends of the flexible arm 312 and extended downwards and forwards, and can move with the flexible arm 312 identically. Each end of each of the two snap hook arms 313 has a snap hook 314. In addition, each of the snap hook arms 313 is disposed inside the frame body 220, and each of the snap hooks 314 is removably snapped at one hook opening.

The pull belt 320 has a first end 321 and a second end 322 opposite to the first end 321. The first end 321 passes through the second opening slit 124 of the front housing 120 and the frame opening 121 to be fasted to the inner frame body. The second end 322 of the pull belt 320 is spanned over a top surface of the flexible arm 312 of the snap hook unit 310, and is passed through the first opening slit of the rear housing 110. There is a height difference between a fix point for fixing the first end of the pull belt 320 to the front housing 120, and the top surface (action surface) for fixing the pull belt 320 to the flexible arm 312. That is, the action surface position of the pull belt 320 on the top surface of the flexible arm 312 is higher that the fixed point position for fixing the first end 321 of the pull belt 320 to the front housing 120.

Figure 4:
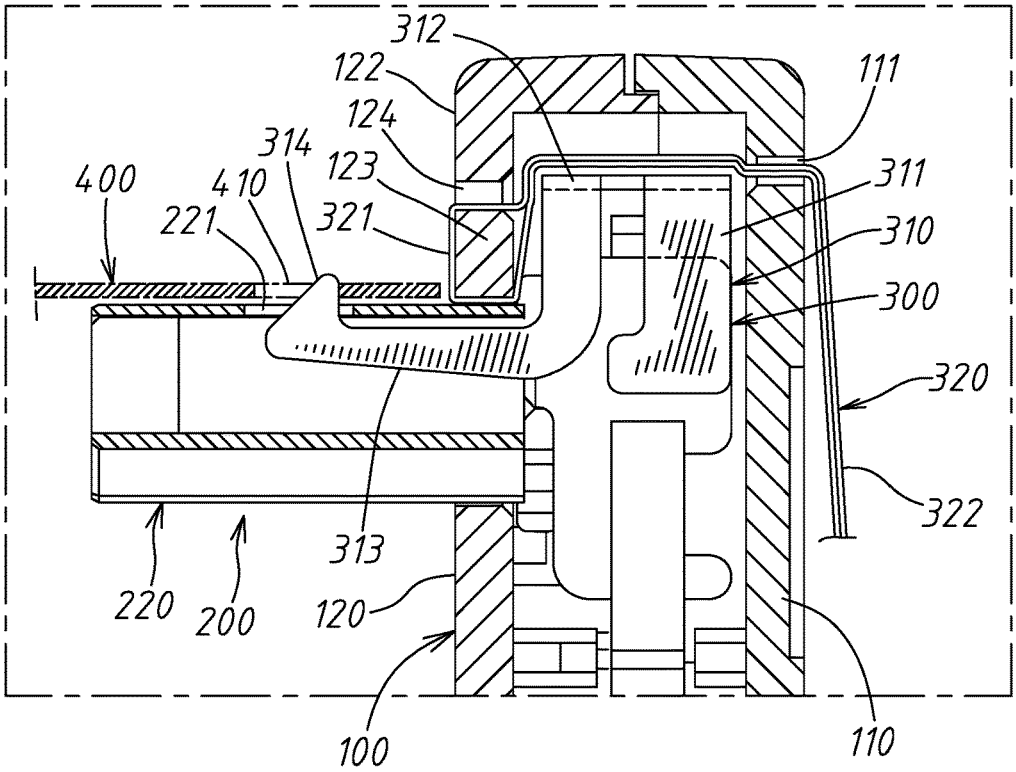
FIG. 4 is a partial, cross-sectional view of the pull-type tripping device of the electrical connector in FIG. 1; and is illustrated in a buckled state.

Refer to FIG. 4. When the second end 322 of the pull belt 320 is loosened, the flexible arm 312 of the snap hook unit 310 and the snap hook arm 313 of the snap hook unit 310 can make the snap hook 314 upturned at the end portion of the snap hook unit 310 due to flexibility thereof, and, hence the snap hook 314 can buckle the hook opening 221 of the frame body 220 and the hook opening 410 on the corresponding electrical connector 400, for maintaining the connection of the electrical connector and the corresponding electrical connector 400.

Figure 5:
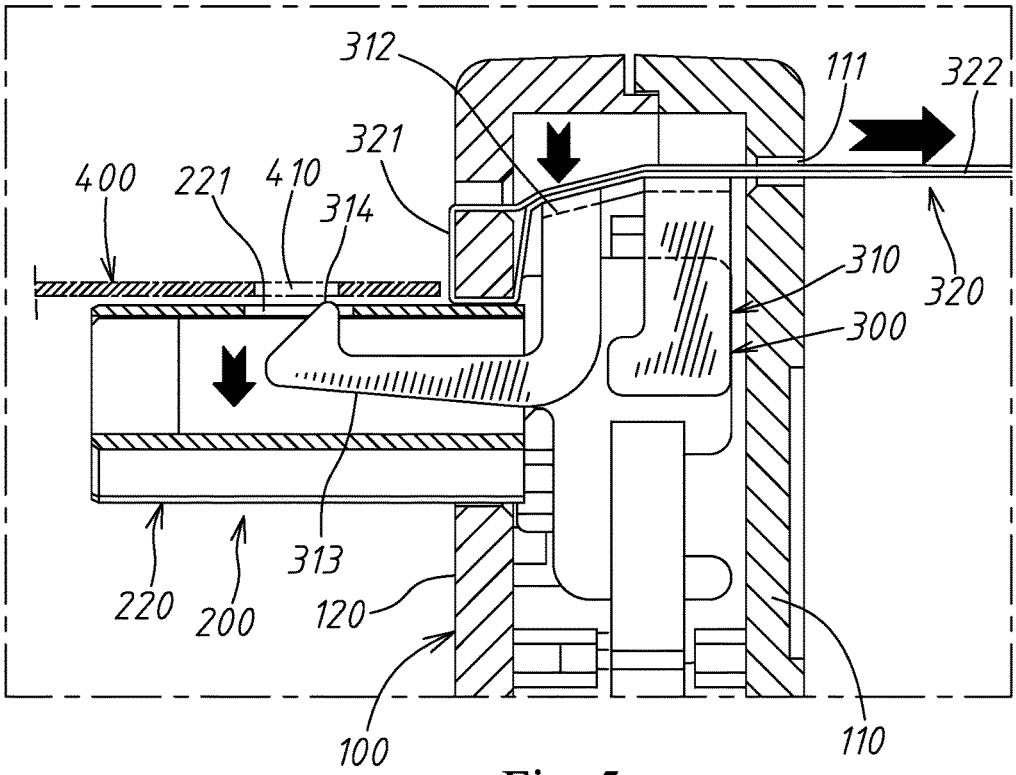
FIG. 5 is a partial cross-sectional view of the pull-type tripping device of the electrical connector in FIG. 1, and shows its operation diagram and it is illustrated in an unbuckled state.

Refer to FIG. 5. When the second end 322 of the pull belt 320 is tightened by pulling outwards, a height difference between the action surface of the pull belt 320 and the fixing point will cause the pull belt 320 located on the top surface (action surface) of the flexible arm 312 to provide a downward action force. The downward action force will make the flexible arm 312 and the snap hook arm 313 to move downwards so that the snap hook 314 at the end of the snap hook arm 313 is moved downwards identically and therefore the hook opening 410 of the corresponding electrical connector 400 is unblocked, thereby allowing the corresponding electrical connector 400 to be pulled out.

According to the pull-type device for the electrical connector according to an embodiment of the present invention, when the space is limited, the unbuckling function can be achieved by pulling the pull belt, and hence the unlock operation can be easily achieved.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A pull-type tripping device with an electrical connector, the electrical connector comprises a housing unit and a connector body unit, the housing unit having a rear housing and a front housing oppositely coupled to the rear housing, the rear housing having a first opening slit, the connector body unit disposed inside the housing unit, the connector body unit having a board body and a frame body vertically coupled to the board body, a plurality of contact terminals inside the frame body, and a hook opening formed on each upper portion of two sides of the frame body, wherein the pull-type tripping device further comprises:

a snap hook unit having:

a fix arm spanned and fixed on a top surface of the board body;

a flexible arm disposed consecutively at a front end of the fix arm and extended along two sides of the fix arm; and two snap hook arms respectively disposed at two outer ends of the flexible arm and extended downwards and forwards, wherein each of the two snap hook arms has a snap hook, each of the two snap hook arms is disposed inside the frame body, and each of the snap hooks is removably buckled with the hook opening; and a pull belt having a first end and a second end opposite to the first end, wherein the first end is fixed to the front housing, the second end spanned over a top surface of the flexible arm and passed through the first opening slit, and a position of the second end of the pull belt on the top surface of the flexible arm is higher than a fixed point position for fixing the first end of the pull belt to the front housing.

2. The pull-type tripping device for the electrical connector of claim 1, wherein an upper portion of the front housing has a frame opening, and the front housing has an outer frame body, and an inner frame body is disposed at the upper portion of the front housing, the inner frame body is placed between the outer frame body and the frame opening, and a second opening slit is formed between the inner frame body and the outer frame body, the first end of the pull belt passes through the second opening slit and the frame opening to be fastened to the inner frame body.

3. The pull-type tripping device for the electrical connector of claim 2, wherein the frame body of the connector body unit protrudes outward through the frame opening of the front housing.

* * * * *